US005208970A

United States Patent [19]

Ishikawa

[11] Patent Number: 5,208,970

[45] Date of Patent: May 11, 1993

[54] APPARATUS FOR FEEDING SLIDE FASTENER CHAIN WITH ATTACHED FABRIC STRIPS

[75] Inventor: Kiichiro Ishikawa, Marietta, Ga.

[73] Assignee: Yoshida Kogyo K. K., Tokyo, Japan

[21] Appl. No.: 935,967

[22] Filed: Aug. 27, 1992

[51] Int. Cl.[5] ..... A41H 37/06

[52] U.S. Cl. ..... 29/768; 29/766

[58] Field of Search ..... 29/408, 766, 767, 768, 29/769, 33.2

[56] References Cited

U.S. PATENT DOCUMENTS

| | | | |
|---|---|---|---|
| 4,594,925 | 6/1986 | Ishikawa | 83/209 |
| 4,638,557 | 1/1987 | Sengupta | 29/766 |
| 4,771,522 | 9/1988 | Osaki | 29/33 |
| 4,882,824 | 11/1989 | Dziura et al. | 29/33 |
| 4,989,851 | 2/1991 | Maede et al. | 270/41 |
| 5,114,057 | 5/1992 | Ishikawa | 223/37 |
| 5,142,772 | 9/1992 | Yunoki | 29/768 |

FOREIGN PATENT DOCUMENTS 4-90704 3/1992 Japan .

*Primary Examiner*—P. W. Echols

*Attorney, Agent, or Firm*—Hill, Steadman & Simpson

[57] ABSTRACT

An apparatus for feeding a continuous slide fastener chain having strips of fabric secured on outer edges of tapes at predetermined intervals comprise a pair of guide members defining therebetween a feed path for feeding a continuous chain with attached strips along, and a drive endless belt unit mounted on either one of the guide members for pressing contact with the continuous chain with attached strips over a suitable length thereof and connected with a drive source to positively feed the continuous chain with attached strips along the feed path; so that, if heavy fabric strips are attached thereto, the continuous chain with attached strips can be fed smoothly and stably.

7 Claims, 6 Drawing Sheets

APPARATUS FOR FEEDING SLIDE FASTENER CHAIN WITH ATTACHED FABRIC STRIPS

BACKGROUND OF THE INVENTION

1. Field of the Invention

The present invention relates to an apparatus for feeding a continuous slide fastener chain having strips of fabric attached to one or both outer edges thereof into a subsequent processing station.

2. Description of the Prior Art

In the mass-production of garments, bags, etc. having slide fasteners attached thereto as a closure for openings, it is customary to first sew strips of fabric successively to opposite edges of a continuous slide fastener chain at predetermined intervals. Then, the slide fastener chain with attached fabric strips is fed longitudinally into a subsequent processing station such as a slide-mounting station and a cutting station in which the slide fastener chain is severed transversely between the adjacent strips into a succession of slide fasteners of individual lengths. Finally, the fabric strips attached with the slide fasteners are processed or finished into garments, bags, etc.

One such known practice is disclosed in U.S. Pat. No. 4,989,851. The conventional apparatus according to this U.S. patent comprises a guide mechanism having a guide slit formed longitudinally therein and adapted for guiding a continuous slide fastener chain having strips of fabric attached thereto and a gripper for gripping the leading end of the slide fastener chain and dragging the slide fastener chain downstream to a subsequent cutting station in which the slide fastener chain is severed transversely between adjacent strips into a succession of slide fasteners of individual lengths.

Since having relatively heavy fabric strips attached thereto, the continuous slide fastener chain is subject to severe frictional resistance while it is dragged by the gripper. Consequently, the gripper cannot sometimes drag the slide fastener chain in proper posture, thereby causing the attached fabric strips to be caught in neighboring parts of the apparatus, so that smooth and stable feeding cannot be accomplished. If the things become worse and the severe frictional resistance surpasses the gripping force of the gripper, then, the continuous slide fastener chain is detached from the gripper.

Another such known practice is shown in U.S. Pat. No. 5,114,057. The conventional apparatus according to this patent comprises a pair of upper and lower guide members located upstream of a cutting station and defining therebetween a feed path to feed a continuous slide fastener chain with fabric strips through and a pair of feed rollers located on the middle of the guide members and holding the continuous slide fastener chain with attached strips therebetween, one of the feed rollers being connected with a drive means for advancing the continuous chain with attached strips downstream along the feed path to a subsequent cutting station in which the slide fastener chain is severed transversely between adjacent strips into a succession of slide fasteners of individual lengths. However, the frictional contact of the feed rollers against the slide fastener chain takes place only at a point at which the two feed rollers contact each other. As mentioned earlier, the continuous slide fastener chain having fabric strips attached thereto is considerably heavy and is thus subjected to severe frictional resistance. With both factors combined, the feed rollers can slip on the slide fastener chain and cannot fully and accurately transmit their rotating force to the slide fastener chain which thus cannot be fed in smooth and stable manner.

SUMMARY OF THE INVENTION

With the foregoing difficulties in view, it is therefore an object of the present invention to provide an apparatus for feeding a continuous slide fastener chain having strips of fabric secured on outer edges of stringer tapes at predetermined intervals to a processing station in smooth and stable manner.

According to the present invention, there is provided an apparatus for feeding to a processing station a continuous slide fastener chain which has a pair of interengaged rows of coupling elements secured on inner edges of respective tapes of a pair of tapes of the slide fastener chain, and strips of fabric secured on an outer edge of one of the tapes at predetermined intervals, said apparatus comprising a pair of opposed upper and lower guide members disposed upstream of the processing station and defining therebetween a feed path for feeding a continuous chain with attached strips along, and a drive endless belt unit mounted on either one of the guide members for pressing contact with the continuous chain with attached strips over a suitable length thereof and connected with a drive source to positively feed the continuous chain with attached strips along the feed path.

The above and other objects, features and advantages of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

The present invention will be described hereinbelow in detail with reference to preferred embodiments shown in the accompanying drawings.

Before commencing a description on a feed apparatus 1 embodying the present invention, a continuous slide fastener chain with attached strips of fabric to be fed by the feed apparatus 1 will be described.

Figures 6A, 6B, 6C:
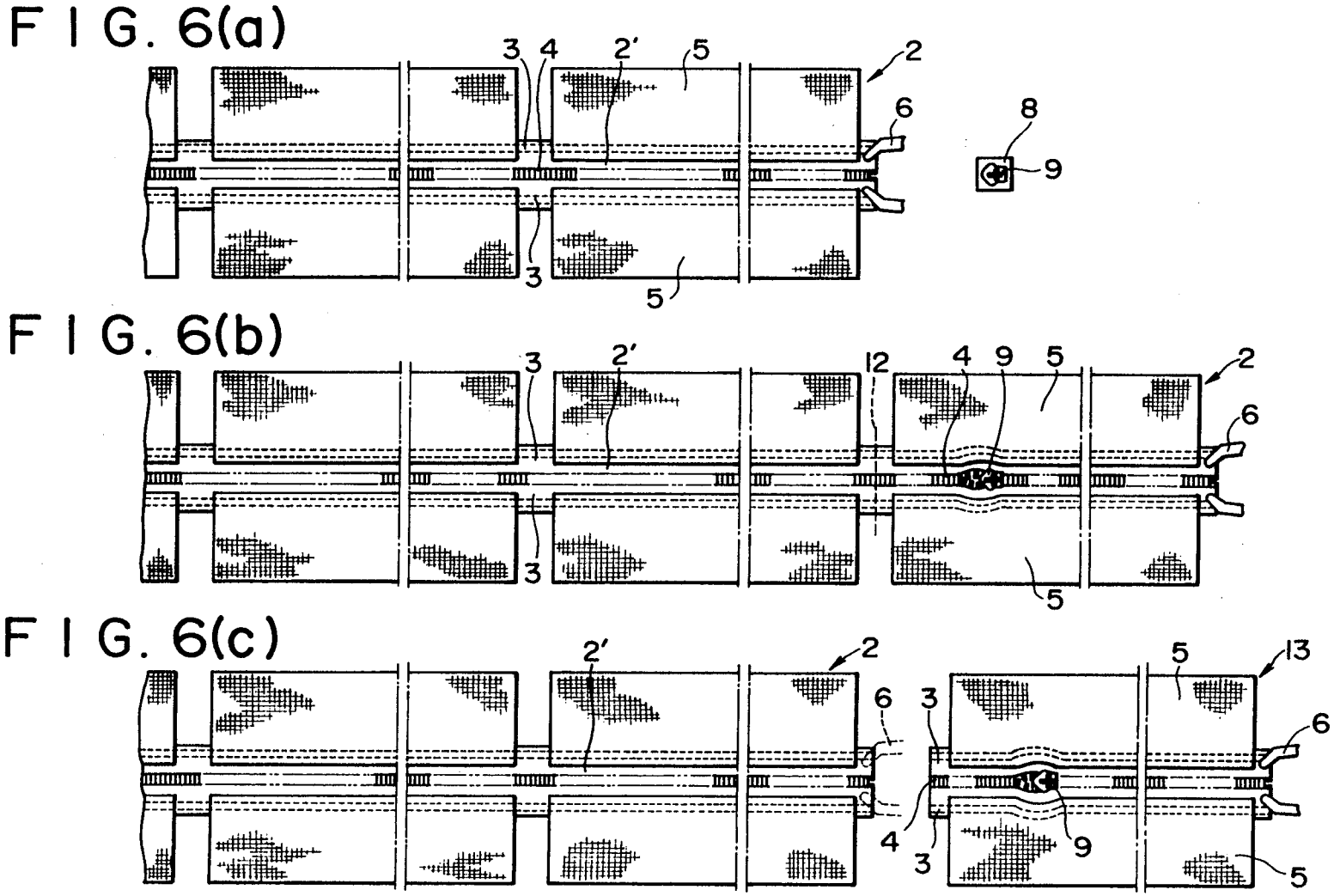
FIGS. 6(*a*), 6(*b*) and 6(*c*) are plan views showing slide fastener chains having fabric strips attached thereto subjected to sequential processing phases while being fed by the apparatus according to the present invention.

The continuous slide fastener chain with attached fabric strips generally designated at 2 in FIG. 6(*a*) includes a continuous slide fastener chain 2' having a pair of stringer tapes 3, 3 and a pair of interengaged rows of coupling elements 4, 4 secured on inner edges of respective stringer tapes 3, 3, and pairs of opposed strips 5, 5 of fabric secured by stiching on outer edges of the respective stringer tapes 3, 3 at predetermined longitudinal intervals. Although the pairs of fabric strips 5, 5 are shown to be secured on the respective outer edges of both stringer tapes, the apparatus 1 can also apply to a continuous slide fastener chain 2' having only one row of fabric strips 5 secured to the outer edge of one of the stringer tapes 3. Alternatively, the apparatus 1 may apply to a continuous slide fastener chain 2' having only one row of fabric strips 5 secured to the outer edge of one of the stringer tapes 3, 3 in such a manner to cover the interengaged rows of coupling elements 4, 4.

Figure 1:
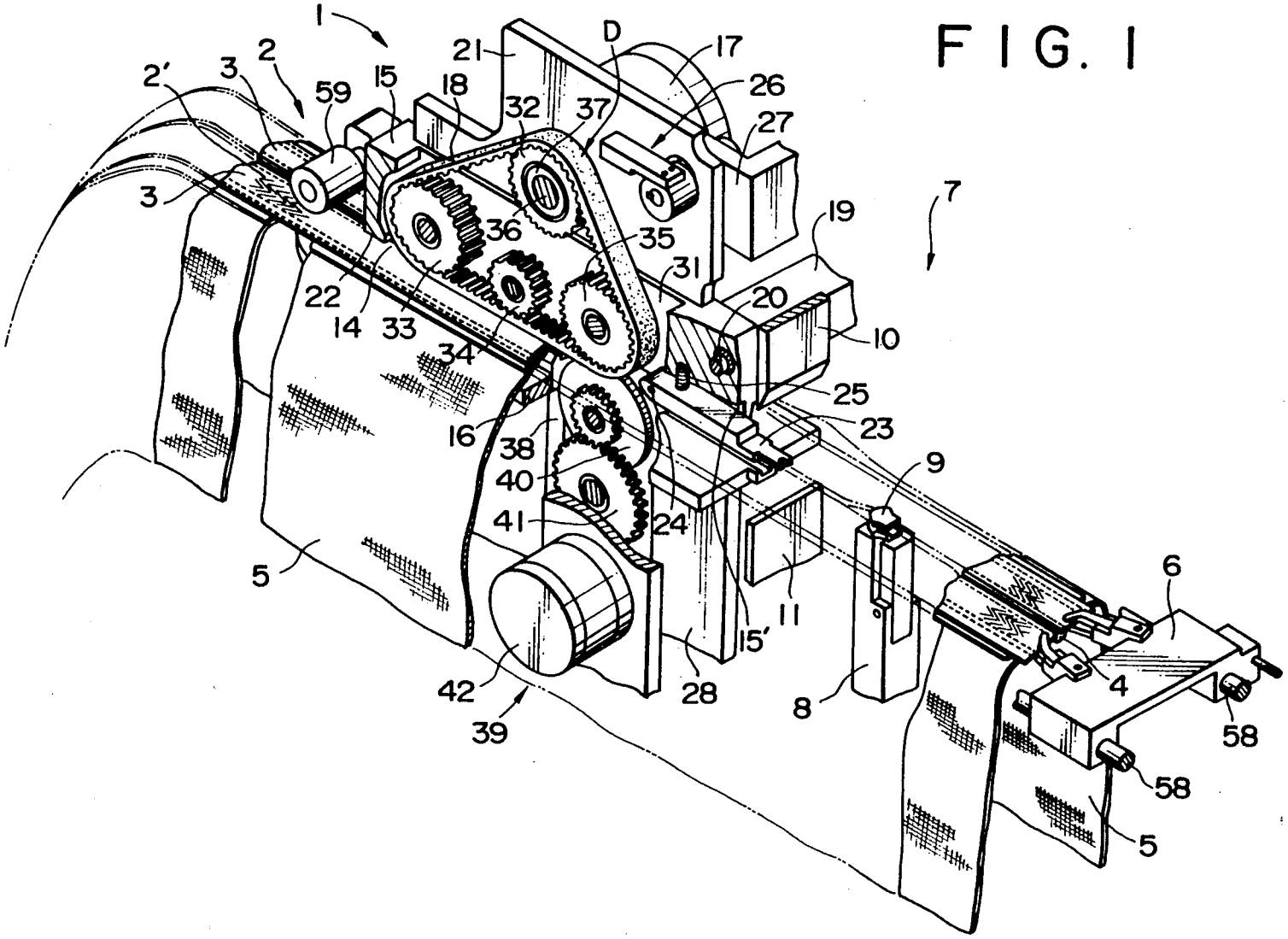
FIG. 1 is a perspective view, with parts cutaway for clarify, of an apparatus embodying the present invention for feeding a continuous slide fastener chain having fabric strips on opposite sides thereof.

The continuous slide fastener chain 2' with attached fabric strips 5, 5 (referred to as "continuous chain with attached strips 2", unless otherwise referred to specifically) is fed longitudinally thereof by the feed apparatus 1 downstream. Then, the leading end of the continuous fastener chain with attached strips 2 is gripped by the gripper 6 and dragged or fed by the gripper 6 downstream to subsequent processing stations such as a slider-mounting station and a cutting station. While thus fed downstream, as shown in FIG. 1, the continuous chain with attached strips 2 is threaded into a slider 9 mounted on a slider holder 8, thus undergoing sequential phases shown in FIGS. 6(*a*) and 6(*b*). Specifically speaking, the coupling element rows 4, 4 are first tentatively disengaged by the gripper 6, inserted from the two inlets in one flared end of the slider 9 through a Y-shaped channel of the slider 9 and then pulled out from one outlet in the other converted end in engaged state. As shown in FIG. 1, a pair of upper and lower blades 10, 11 are provided on the upper and lower sides, respectively, of the feed path 14 and adapted to move vertically toward and away from each other to thus sever the continuous chain with attached strip 2 transversely along a cutting line 12 between the adjacent fabric strips 5, 5, as shown in FIG. 6(*b*), thereby providing a slide fastener of an individual length with attached strips 13, as shown in FIG. 6(*c*). The thus processed slide fastener of an individual length with attached strips 13 includes a slider 9 slidably mounted on the coupling elements rows 4, 4 and a pair of fabric strips 5, 5, attached to the opposed outer edges of the stringer tapes 3, 3.

After subjected to the cutting operation, the slide fastener of an individual length with attached strips 13 is detached from the gripper 6. As shown by a phantom line in FIG. 6(*c*), the gripper 6 advances again and grips the leading end of the continuous fastener chain with attached strips 2. And, the slider-mounting operation and the cutting operation are repeated in the manner described hereinabove.

Figure 2:
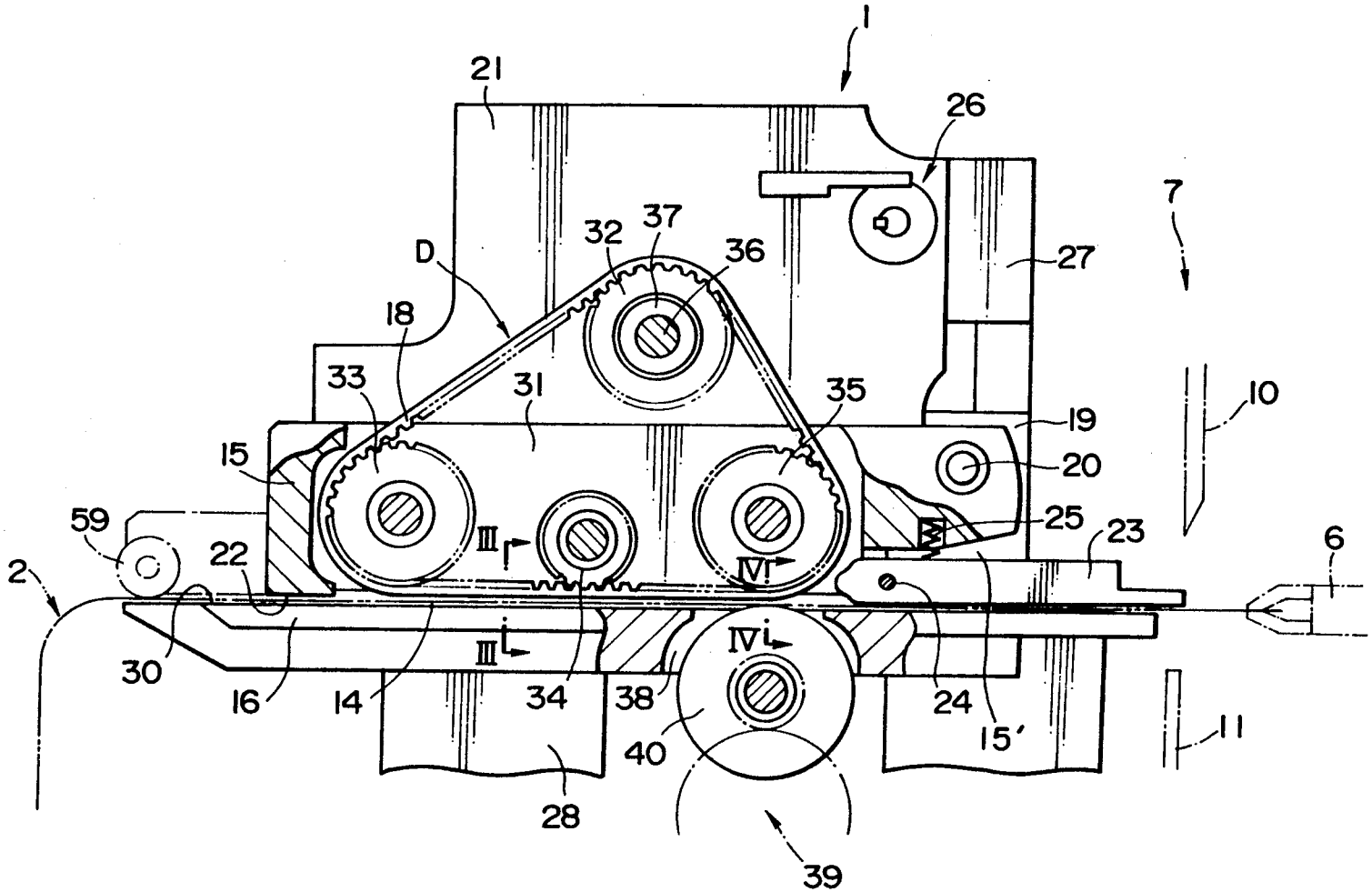
FIG. 2 is a diagrammatical front elevation view, with parts cutaway for clarity, of an essential part of the apparatus of FIG. 1.

As better shown in FIGS. 1 and 2, the feed apparatus 1 broadly comprises a pair of upper and lower guide members 15, 16 defining a feed path 14 therebetween adapted for guiding the continuous chain with attached strips 2 through the feed path 14; and a drive endless belt unit D provided on the upper guide member 15 intermediate of the feed path 14 and connected with a drive source such as an electrical motor 17, the drive endless belt unit D adapted for driving engagement with the slide fastener chain 2' along a predetermined length for feeding the continuous chain with attached strips 2 to a subsequent processing station 7.

As shown in FIG. 1, the upper guide member 15 is pivotally mounted on a pivot pin 20 provided on a support bar 19. The support bar 19 is fixed to a base frame (not shown) of the feed apparatus 1. The upper guide member 15 has a rectangular vertical through slot 31 formed therethrough and disposed in alignment with the feed path 14 for accommodating the drive endless belt unit D closely referred to hereinafter. A vertical base plate 21 is mounted integrally on the upper guide member 15 along one side of the rectangular through slot 31. The upper guide member 15 has a guide surface 22 formed on its lower side on the upstream side thereof and disposed in opposed relation to the stringer tapes 3, 3, of the continuous chain with attached strips 2 for guiding the continuous chain with attached strips 2 along the feed path 14.

As shown in FIGS. 1 and 2, the upper guide member 15 has a rectangular recess 15' formed in a lower surface and on the downstream side thereof. The guide surface 22, the rectangular slot 31 and the rectangular recess 15' are in alignment with each other and are arranged in succession downstream in the sequence as named. An auxiliary guide member 23 is disposed in the recess 15' and has its one end pivotally mounted on the upper guide member 15 via a pivot pin 24. A compression coil spring 25 acts between the lower side of the upper guide member 15 and the upper surface of the auxiliary guide member 23, thereby normally urging the other end of the auxiliary guide member 15 downward.

The vertical base plate 21 is mounted on a bracket 27 fixed to the base frame (not shown) so as to be angularly movable on the pivotal pin 20 between a horizontal position and a second inclined position by a lock mechanism 26 as closely described hereinafter. Since being integral to the vertical base plate 21, the upper guide member 15 is likewise angularly movable on the pivotal pin 20 between the horizontal position and the inclined position.

Figure 3:
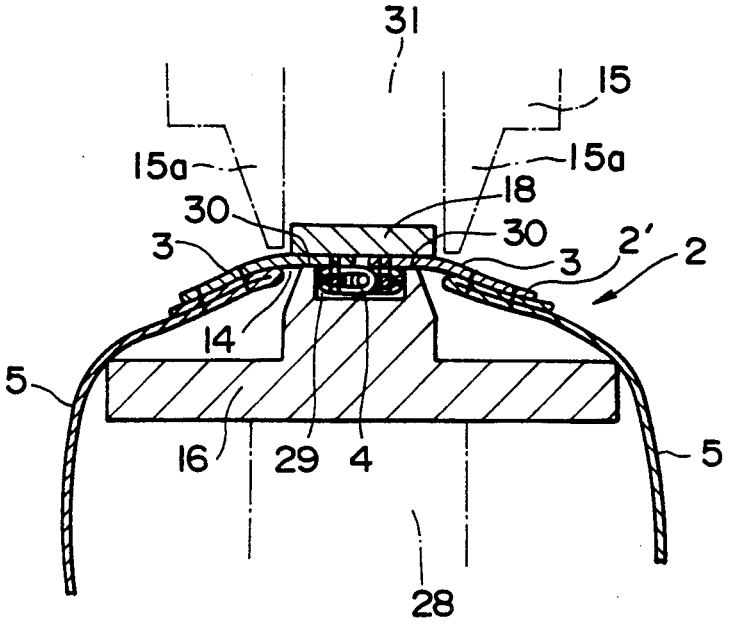
FIG. 3 is an enlarged cross-sectional view taken on line III—III of FIG. 2.

As shown in FIG. 1, the lower guide member 16 is horizontally mounted on a vertical stand 28 fixed to the base frame (not shown). As shown in FIG. 3, the lower guide member 16 has a central guide groove 29 formed in its upper side so as to extend longitudinally thereof for slidably receiving the interengaged rows of coupling elements 4, 4 secured to the opposed inner edges of the stringer tapes 3, 3. A pair of guide ridges 30, 30 are provided on opposite sides of the central guide groove 29 for slidably supporting the stringer tapes 3, 3, adjacent the respective interengaged rows of coupling elements 4, 4.

The upper and lower guide members 15, 16 are parallel to and vertically spaced from each other by a predetermined distance so as to define therebetween the feed path 14 through which the continuous chain with attached strips 2 can be fed horizontally downstream. As better shown in FIG. 3, while the continuous chain with attached strips 2 is fed along the feed path 14, the fabric strips 5, 5 attached to the opposite sides of the continuous slide fastener chain 2' drape down on the opposite sides of the lower guide member 16 via their own gravities.

As shown in FIGS. 1 and 2, the drive end belt unit D comprises a drive timing pulley 32 rotatably mounted on the vertical base plate 21 and connected with a motor 17 as a drive source mounted on the other side of the vertical plate 21; and three driven toothed timing pulleys 33, 34, 35 disposed in a horizontal row in the through slot 31 and mounted rotatably on the upper guide member 15; and an endless timing belt 18 wrapped around the drive timing pulley 32 and the three driven timing pulleys 33, 34, 35. The axes of the driven timing pulleys 33, 34, 35 are positioned such that part of the endless timing belt 18 running on the driven timing pulleys 33, 34, 35 be rectilinear and be brought into pressing contact with the opposed stringer tapes 3, 3 of the continuous chain with attached strips 2 fed along the feed path 14 when upper guide member 15 assumes the horizontal position. With the endless timing belt 18 brought into pressing contact with the opposed stringer tapes 3, 3 over a suitable length thereof, the actuation of the motor 17 causes the endless timing belt 18 to run and positively feed the continuous chain with attached strips 2 downstream along the feed path 14. It is to be noted here that, since the endless timing belt 18 is brought into pressing contact with the opposed stringer tapes 3, 3 over a suitable length thereof, this ensures the positive transmission of the rotating motion of the endless timing belt 18 to the continuous chain with attached strips 2, so that, under severe stresses exerted by heavy fabric strips 5 attached thereto, the continuous chain with attached strips 2 can be fed downstream along the feed path 14 in smooth and stable manner.

It is acknowledged from FIG. 3 that the slot 31 is slightly greater in width than the endless timing belt 18 and that the opposed walls 15*a*, 15*a* of the upper guide member 15 defining the slot 31 therebetween reach substantially to the level of the lowermost end of the endless timing belt 18. This advantageously prevents the endless timing belt 18 from being laterally displaced from the feed path 14. The motor 17 is preferably a servo motor so as to make a controlled and accurate supply of the continuous chain with attached strip 2 by a predetermined length one time downstream to the processing station 7. The drive timing pulley 32 is mounted on the drive shaft 36 of the motor 17 via a one-way clutch 37 so that the endless timing belt 18 can run only one such direction as to feed the continuous chain with attached strips 2 downstream, as closely described hereinafter.

Figure 4:
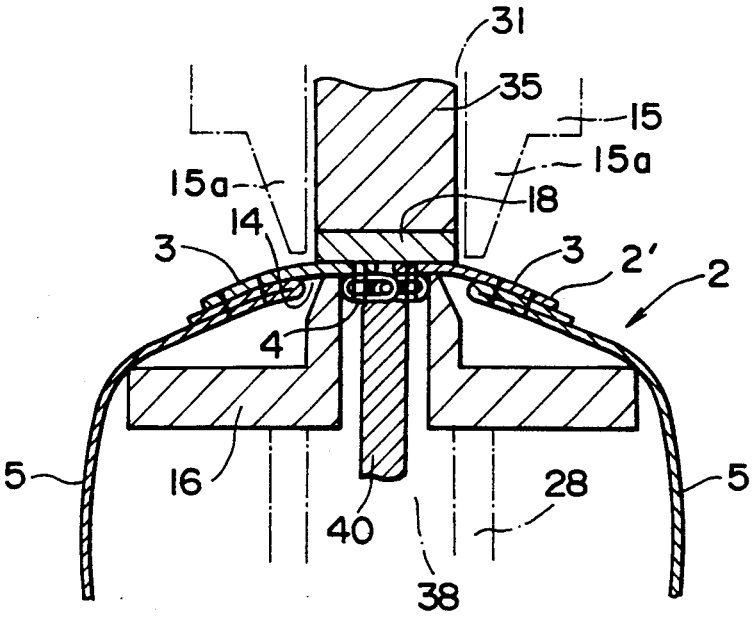
FIG. 4 is an enlarged cross-sectional view taken on line IV—IV of FIG. 2.

The lower guide member 16 has a rectangular lower vertical slot 38 formed vertically therethrough and is disposed in vertical alignment with the upper vertical slot 31 of the upper guide member 15. Measuring means 39 is provided in the lower vertical slot 38 to measure the amount of travel of the continuous chain with attached strips 2 along the feed path 14. As shown in FIGS. 1, 2 and 4, the measuring means 39 comprises a measuring roller 40 disposed below the driven timing pulley 35 and rotatably mounted on the stand 28 so as to come into pressing contact with the interengaged rows of coupling elements 4, 4, of the continuous chain with attached strips 2 fed along the feed path 14 and a rotary encoder 42 coupled with the measuring roller 40 through a plurality of transmission gears 41. A compression coil spring (not shown) urges the measuring roller 40 upward against the continuous chain with attached strips 2, to thus ensure that the motion of the continuous chain with attached strips 2 is reliably transmitted to the measuring roller 40 and accurate measuring can be accomplished therewith. The measuring means 39 controls the motor 17 so as to feed the continuous chain with attached strips 2 by a predetermined length at one time downstream to the processing station 7, and at the same time, transmits a signal to the processing station 7 so that processing operations commence immediately after the continuous chain with attached strips 2 stops. Such measuring means is well known in this field and consequently, it is not necessary to describe it in further detail.

Figure 5:
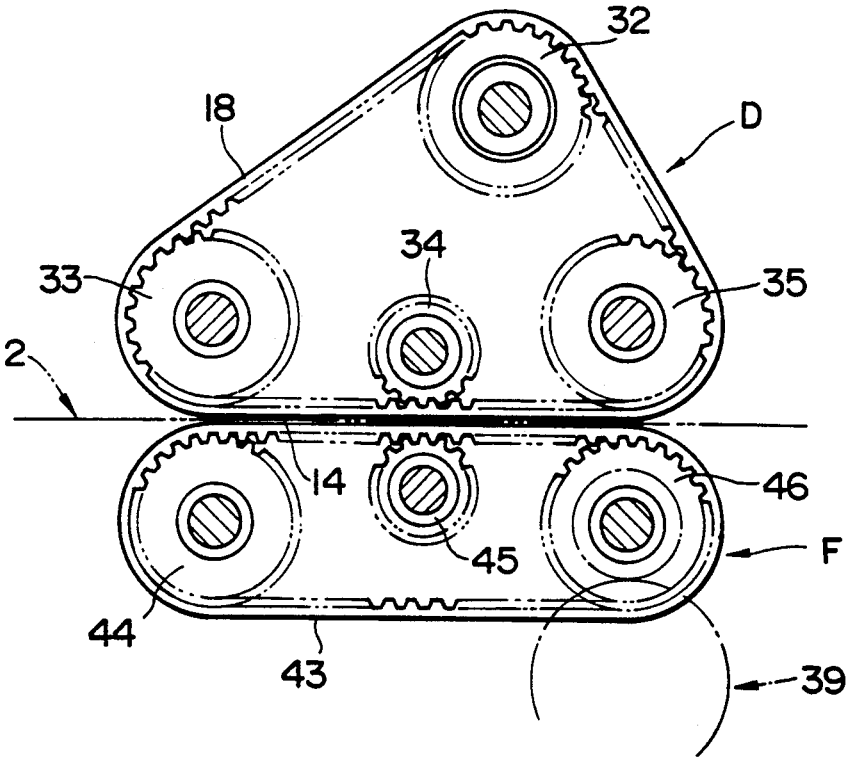
FIG. 5 is a diagrammatical front elevational view of an essential part of an apparatus according to another embodiment of the present invention.

In the preceding embodiment, as better shown in FIG. 2, the drive endless belt unit D slidably feeds the continuous chain with attached strips 2 on the upper surface of the lower guide member 16. Alternatively, as shown in FIG. 5, a free-wheeling endless belt unit F may be mounted in the lower vertical slot on the lower guide member 16 and disposed in opposed relation to the drive belt unit D to thus define with the drive belt unit D a feed path 14 to feed the continuous chain with attached strips 2 along. The drive endless belt unit D and the free-wheeling endless belt unit F hold therebetween the continuous chain with attached strips 2. This arrangement further ensures the positive transmission of the rotating motion of the endless timing belt 18 to the continuous chain with attached strips 2, so that, under severe stresses exerted by heavy fabric strips 5 attached thereto, the continuous chain with attached strips 2 can be fed downward along the feed path 14 in smooth and stable manner. The free-wheeling endless belt unit F comprises three timing pulleys 44, 45, 46 disposed in a horizontal row and a free-wheeling endless timing belt 43 trained around the three timing pulleys 44, 45, 46. The axes of the timing pulleys 44, 45, 46 are positioned such that a horizontal part of the endless timing belt 43 running on the timing pulleys 44, 45, 46 be rectilinear and be brought into pressing contact with the continuous chain with attached strips 2 fed along the feed path 14. In this embodiment, instead of provision of the separate measuring roller 40, any one of the timing pulleys 44, 45, 46 of the free-wheeling endless belt unit F (the timing pulley 46 in FIG. 5) is connected with an encoder to serve as measuring means 39. With the free-wheeling endless timing belt 43 brought into pressing contact with the continuous chain with attached strips 2 over a suitable length, the measuring means 39 can carry out more accurate measurement of the amount of travel of the continuous chain with attached strips 2 along the feed path 14.

Figure 7:
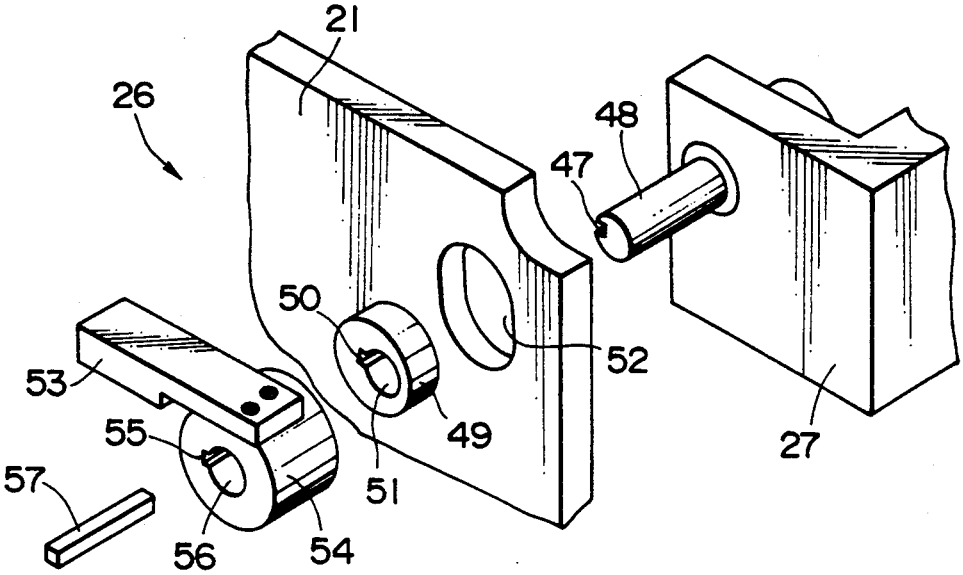
FIG. 7 is an exploded perspective view of a lock mechanism of the apparatus of FIG. 1.

Description is now made of the lock mechanism 26 in reference to FIGS. 1 and 2. The lock mechanism 26 is intended to angularly move the vertical base plate 21 on the pivot pin 20 between the horizontal position and the inclined position and to lock the vertical base plate 21 and the upper guide member 15 integral thereto in the horizontal position. As shown in FIG. 7, the lock mechanism 26 comprises a rotary shaft 48 mounted on the bracket 27 so as to rotate through a predetermined angle; an eccentric circular cam 49; an actuating rotor 54 fit over the rotary shaft 48 in the sequence named; and a key 57 described hereinafter. The rotary shaft 48 has a key groove 47 cut axially thereof. The eccentric circular cam 49 has an eccentric circular hole 51 formed axially but eccentric thereof and it also has a key groove 50 cut to communicate with the eccentric circular hole 51. The actuating rotor 54 has a central hole 56 formed axially and centrally thereof and it also has a key groove 55 cut to communicate with the central hole 56. An actuating lever 53 has its one end fastened to the periphery of the actuating rotor 54 and has its other end protruding outward to facilitate the rotation of the actuating rotor 54. For assembling the lock mechanism 26, first the eccentric circular cam 49 is inserted into an oblong hole 52 formed in the vertical base plate 21. The eccentric circular cam 49 inserted in the oblong hole 52 of the vertical base plate 21 is fit over the rotary shaft 48. Then, the actuating rotor 54 is fit over the rotary shaft 48. Finally, a key 57 is inserted through the key grooves 55, 50, 47 so as to fasten the eccentric circular cam 49 and the actuating rotor 54 to the rotary shaft 48.

Figure 8A:
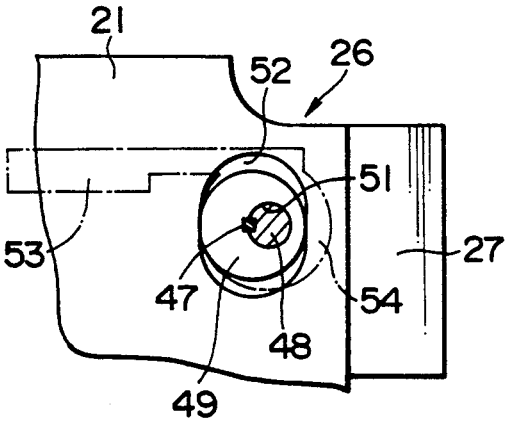
FIGS. 8(*a*) and 8(*b*) are fragmentary front views showing sequential steps of the operation of the lock mechanism of FIG. 7.
Figure 8B:
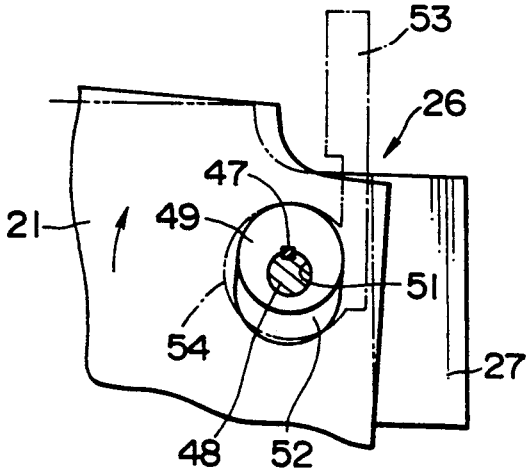

With the construction set forth above, the lock mechansim 26 operates as follows:

As shown in FIG. 8 (*a*), when the actuating lever 53 assumes a horizontal position, the vertical base plate 21 and hence the lower guide member 15 assume the horizontal position in which the upper guide member 15 defines with the lower guide member 16 the feed path 14 for feeding the continuous chain with attached strips 2 along.

As shown in FIG. 8(*b*), rotation of the actuating lever 53 clockwise causes the eccentric cam 49 to rotate similary clockwise within the oblong hole 52, thereby rotating the vertical base plate 21 clockwise on the pivot pin 20. As the vertical base plate 21 is rotated on the pivot pin 20 clockwise, the upper guide member 15 is separated from the lower guide member 16. As a result, the upper guide member 15 and the lower guide member 16 spread apart to get ready for receiving the continuous chain with attached strips 2 to be subjected to the finishing process.

After the continuous chain with attached strip 2 is set between the spread-apart upper and lower guide members 15, 16, the actuating lever 53 is angularly moved counterclockwise until it assumes the horizontal position as shown in FIG. 8(*a*). As a result, the upper guide member 15 is restored into the horizontal position so that the continuous chain with attached strips 2 has been fully set for feeding to the processing station 7. This lock mechanism 26 facilitates setting of the continuous chain with fabric strips 2 on the feed apparatus 1, and especially so with the continuous chain 2' with heavy and cumbersome fabric strips 5.

Description is now made of the processing station 7 disposed downstream.

As shown in FIG. 1, in the processing station 7, there are provided a gripper 6 reciprocally movable along the feed path 14 to feed the continuous chain with attached strips 2 to the processing station 7; a slider holder 8 mounted below the feed path 14 and being vertically movable toward and away from the feed path 14 for inserting the continuous chain with attached strips 2 into sliders 9; and upper and lower cutting blades 10, 11 disposed above and below, respectively, the feed path 14 and being vertically movable toward and away from each other to sever the continuous chain with attached strip 2 transversely between the adjacent fabric strips 5, 5 to provide slide fasteners of the predetermined individual length with attached strips 13. Since the construction of these elements are well-known in this field, no further description thereof need to be made. In addition, a top stop attaching device and/or a bottom stop attaching device may be provided in the processing station 7. Reference numerals 58, 58 in FIG. 1 denote a pair of guide rods (only partly shown for brevity in FIG. 1) on which the gripper 6 is reciprocally mounted to feed the continuous chain with attached strip 2.

As shown in FIGS. 1 and 2, a presser roller 59 is provided upstream of the upper guide member 15 and urged by a suitable compression spring (not shown) downward to thus press the continuous chain with attached strip 2 against the forward part of the lower guide member 16 which extends upstream beyond the forward end of the upper guide member 15. This presser roller 59 is intended to prevent the fabric strips 5, 5 from deflecting toward the interengaged rows of coupling elements which would cause the fabric strips 5, 5 objectionably to wedge into the feed path 14.

Turning now to the operation of the feed apparatus 1 according to the present invention in conjunction with the processing station disposed downstream.

First, the actuating lever 53 of the lock mechanism 26 is rotated clockwise to the vertical position, causing the vertical base plate 21 and the upper guide member 15 to rotate on the pivot pin 20 to the inclined position so that the upper guide member 15 and the lower guide member 16 are spread apart for receiving the continuous chain with attached strips 2 therebetween. Then, the continuous chain with attached strips 2 is set on the lower guide member 16 with the leading end of the former placed beneath the downstream end of the auxiliary guide member 23.

Subsequently, the actuating lever 53 is rotated counterclockwise to the horizontal position, causing the vertical base plate 21 and the upper guide member 15 to rotate on the pivot pin 20 into the horizontal position. As a result, the drive endless belt unit D is brought into pressing contact with the continuous chain with attached strips 2 over a suitable length. Additionally, the auxiliary guide member 23 comes into pressing contact with the continuous chain 2 with attached strips 2 under resiliency of the compression spring 25. Actuating the motor 17 with the feed apparatus 1 assuming this disposition causes the endless timing belt 18 to run to thus feed the continuous chain with attached strips 2 downstream.

The gripper 6 assumes a stand-by position immediately downstream of the feed apparatus 1. As soon as the continuous chain with attached strips 2 comes out of the feed apparatus 1, the gripper 6 grips the leading end of the continuous chain with attached strips 2. Thereafter, the continuous chain with attached strips 2 is fed downstream jointly by both the endless timing belt 18 and the gripper 6. It is to be noted here that, since the endless timing belt 18 runs with its horizontal part brought into pressing contact with the continuous chain with attached strips 2 over a suitable length, the endless timing belt 18 positively feeds the continuous chain with attached strips 2, and that, as combined with dragging forces of the gripper 6, the endless timing belt 18 feeds the continuous chain with attached strips 2 much more positively. Even if having a great number of heavy and cumbersome fabric strips 5, 5 are attached thereto, the continuous chain with attached strips 2 can be fed smoothly and reliably. The same is still true even if the continuous chain with attache strips 2 is subjected to severe resistance while being threaded through a slider 9 mounted on the slider holder 9.

The speed of the gripper 6 dragging the continuous chain with attached strips 2 and the speed of the endless timing belt 18 running are set such that the former is equal to or slightly lower than the latter. As mentioned earlier, the one-way clutch 37 is provided between the drive shaft 36 of the motor 17 and the drive timing pulley 32 so that the timing belt 18 can freely run in only one such direction as to feed the continuous chain with attached strips 2 downstream. Consequently, the timing belt 18 can run at higher speed than the motor 17 drives the endless timing belt 18. As a result, if the speed of the gripper 6 dragging the continuous chain with attached strips 2 becomes higher than the speed of the endless timing belt 18 running, then the speed of the endless timing belt 18 running can be adapted to the speed of the gripper 6 dragging the continuous chain with attached strips 2, irrespective of the speed at which the motor 17 drives the endless timing belt 18. The provision of the one-way clutch 37 has advantageously dispensed with time-consuming and tedious adjustment of the speed of the endless timing belt 18 running and the speed of the gripper 6 dragging the continuous chain with attached strips 2 relative to each other.

The continuous chain with attached strips 2 is thus fed smoothly to the processing station 7 jointly by the endless timing belt 18 and the gripper 6 and is threaded through a slider 9 mounted on a slider holder 8. The measuring means 39 functions to measure the amount of travel of the continuous chain with attached strips 2. When the measuring means 39 measures a predetermined length corresponding to the length of a finished slide fastener, the measuring means 39 transmits signals to the motor 17 for the endless timing belt 18 and a drive source (not shown) for the gripper 6, so as to discontinue the operation of the endless timing belt 18 and the gripper 6, respectively and at the same time transmits signals to the upper and lower blades 10, 11 to sever the continuous chain with attached strips 2 transversely across the foremost gap between the adjacent fabric strips 5, 5, to provide slide fasteners of a predetermined length.

As better shown in FIG. 2, while the continuous chain with attached strips 2 is severed by the upper and lower blades 10, 11, the continuous chain with attached strips 2 is urged by the auxiliary guide member 23 under the resiliency of the compression spring 25 against the lower guide member 16, so that the severance can be carried out very accurately and stably.

After the severance is over, the gripper 6 is retracted downstream and then release a slide fastener of an individual length with attached strips 13. Subsequently, the gripper 6 advances upstream to the downstream side of the upper and lower guide members 15, 16 to grip the leading end of the continuous chain with attached strips 2. The above-mentioned cycle of operation will repeat.

With the construction of the present invention set forth above, even if heavy and cumbersome fabric strips are attached to the continuous slide fastener chain, the continuous slide fastener chain can be fed downstream to a subsequent processing station smoothly and stably.

Obviously, the skilled person would realize that various modifications and variations of the present invention are possible in the light of the above teaching. It is therefore to be understood that within the scope of the appended claims the invention may be practiced otherwise than as specifically described, and that the invention is not limited to the embodiments described above in detail.

What is claimed is:

1. An apparatus for feeding to a processing station a continuous slide fastener chain which has a pair of interengaged rows of coupling elements secured on inner edges of respective tapes of a pair of tapes of the slide fastener chain, and strips of fabric secured on an outer edge of at least one of the tapes at predetermined intervals, said apparatus comprising:

(a) a pair of opposed upper and lower guide members disposed upstream of the processing station and defining therebetween a feed path for feeding a continuous chain with attached strips along; and (b) a drive endless belt unit mounted on either one of the guide members for pressing contact with the continuous chain with attached strips over a suitable length thereof and connected with a drive source to positively feed the continuous chain with attached strips along the feed path.

2. An apparatus according to claim 1, the apparatus further including a gripper mounted in the processing station so as to reciprocate along the feed path to grip and drag the continuous chain with attached strips through the processing station.

3. An apparatus according to claim 1 or 2, said drive endless belt unit connected with the drive source through a one-way clutch so as to freely run in only one such direction as to feed the continuous chain with attached strips downstream.

4. An apparatus according to claim 1, the other guide member having measuring means which is held in contact with the continuous chain with attached strips to measure the amount of travel thereof.

5. An apparatus according to claim 1, the other guide member having a free-wheeling endless belt unit mounted thereon in opposed relation to the drive endless belt unit, the drive endless belt unit and the free-wheeling endless belt unit holding therebetween the continuous chain with attached strips.

6. An apparatus according to claim 5, the free-wheeling endless belt unit being connected with measuring means.

7. An apparatus according to claim 1 or 5, the drive endless belt unit and the free-wheeling endless belt unit comprising timing belts.

* * * * *